US007484911B2

(12) United States Patent
Frelich

(10) Patent No.: US 7,484,911 B2
(45) Date of Patent: Feb. 3, 2009

(54) PAVING PROCESS AND MACHINE WITH FEED FORWARD MATERIAL FEED CONTROL SYSTEM

(75) Inventor: Toby Andrew Frelich, Saint Michael, MN (US)

(73) Assignee: Caterpillar Inc., Peoria, IL (US)

( * ) Notice: Subject to any disclaimer, the term of this patent is extended or adjusted under 35 U.S.C. 154(b) by 18 days.

(21) Appl. No.: 11/500,685

(22) Filed: Aug. 8, 2006

(65) Prior Publication Data

US 2008/0038059 A1 Feb. 14, 2008

(51) Int. Cl.
*E01C 23/07* (2006.01)

(52) U.S. Cl. ..... 404/75; 404/84.05; 404/108; 222/71

(58) Field of Classification Search ..... 404/75, 404/84.05, 84.1; 222/52, 71; 700/283, 304
See application file for complete search history.

(56) References Cited

U.S. PATENT DOCUMENTS 3,678,817 A * 7/1972 Martenson et al. ..... 404/72
3,967,912 A * 7/1976 Parker ..... 404/84.05
4,012,160 A * 3/1977 Parker ..... 404/84.05
5,234,128 A * 8/1993 Hill ..... 222/63
5,356,238 A 10/1994 Musil et al.
5,362,176 A 11/1994 Sovik
5,362,177 A 11/1994 Bowhall et al.
5,393,167 A 2/1995 Fujita et al.
5,401,115 A 3/1995 Musil et al.
5,484,226 A 1/1996 Emerson et al.
5,484,227 A 1/1996 Ikeda et al.
5,549,412 A 8/1996 Malone
5,568,992 A 10/1996 Grembowicz et al.
5,575,583 A 11/1996 Grembowicz et al.
5,599,134 A * 2/1997 Macku et al. ..... 404/84.1
5,752,783 A 5/1998 Malone
5,863,149 A 1/1999 Gustin
6,027,282 A 2/2000 Horn
6,161,986 A * 12/2000 Smith et al. ..... 404/75
6,520,715 B1 2/2003 Smith
6,582,152 B2 6/2003 Leone et al.
6,595,719 B1 7/2003 Ohseki et al.
2002/0168226 A1 11/2002 Feucht et al.
2006/0045620 A1 3/2006 Olson et al.

* cited by examiner

*Primary Examiner*—Gary S Hartmann
(74) *Attorney, Agent, or Firm*—Liell & McNeil

(57) ABSTRACT

A method of paving includes sensing values indicative of a material feed demand of a surface to be paved, and depositing material onto the surface. An electronic controller is configured to generate a control signal corresponding with a feed forward term associated with an expected change in the material feed demand. The method also includes controlling depositing material onto the surface responsive to the control signal. A machine such as a paving machine includes a control system in control communication with a material feed system and having an electronic controller configured to determine an expected material feed demand and responsively output material feed rate control signals to the feed apparatus to control depositing material onto the surface.

20 Claims, 3 Drawing Sheets

PAVING PROCESS AND MACHINE WITH FEED FORWARD MATERIAL FEED CONTROL SYSTEM

TECHNICAL FIELD

The present disclosure relates generally to processes and machines for paving, and relates more particularly to a paving process and machine having feed forward control over depositing material onto a work surface responsive to an expected material feed demand.

BACKGROUND

Roads, parking lots and other surfaces are often paved with material such as a mixture of asphalt and gravel to provide a sealed, durable, traffic-bearing surface. A variety of relatively sophisticated machines and processes are used to apply a "mat" of hot asphalt onto the surface to be paved. Following deposition of the paving material onto the surface, the material is typically compacted with a separate compactor machine to a desired state. In most paving operations, it is desirable to deposit paving material in such a manner that a relatively smooth and uniform surface results. Producing a paved surface to desired specifications can be a relatively challenging process, however, requiring relatively highly skilled paving machine operators, often working in cooperation with other machine operators and technicians. Paving contractors tend to be compensated based at least in part on the quality of the end product. Bonuses are typical for superior work, exceeding specifications; re-work or penalties are not uncommon for nonconforming jobs.

One type of common paving machine consists of a self-propelled machine having a paving material hopper, a material feed system and a "screed." The screed is typically supported by the machine and trails behind it such that it "floats" on top of freshly deposited asphalt to smooth and compact the same, in preparation for further work by a dedicated compacting machine. One factor which has been discovered to affect the end quality of a paving job relates to deposition of paving material in front of a paving machine screed during operation. In particular, where the paving material is deposited at an inappropriate thickness or "head height" onto the work surface in front of the screed, variations in the smoothness, regularity and overall quality of the asphalt mat can result. Control over the head height of the freshly deposited paving material in front of the screed is conventionally achieved via the use of one or more mechanical contact sensors or one or more sonic sensors which output signals indicative of the paving material head height such that a material feed system of the paving machine may reactively speed up or slow down, by either electronic or operator control.

While utilizing contact sensors has proven more useful than operator guesswork, or visual inspection, a variety of factors can affect the ability of an operator or control system to adequately address changes in material feed demand. As a result, paving operations can create waves in the paved surface corresponding with instances of too great and/or too little paving material head height in front of the screed. Where machine propel speed is increased, for example, a corresponding adjustment in material feed in the paving machine may be necessary. In a conventional reactive system, paving material feed is not increased or decreased to accommodate a change in machine propel speed until after a drop or an increase in head height is detected. Similarly, extension and retraction of a variable width screed can affect the material feed demand in a manner not adequately addressed by reactive material feed control systems. Despite advances in paving strategies, control system sophistication, and machine positioning technology, reactive approaches to changes in material feed demand have been shown to be inadequate, and the many instances of lower quality paving work reflect the shortcomings associated with the conventional state of the art.

One attempt at paving machine design and control that is directed toward improved paving quality is known from U.S. Pat. No. 6,520,715 to Smith ("Smith"). The machine in Smith utilizes a material feed system to deposit a relatively large volume of paving material onto a work surface. Excess paving material is then removed from the large pile of material as the machine travels across a work surface by an adjustable, multi-bladed assembly. Material which is removed by the multiple blades is then returned to a storage bin in anticipation of re-deposition. Smith's machine accounts for variations in paving thickness across a width and longitudinal dimension of the work surface to be paved, via its paring away of material from the pile deposited onto the work surface. While Smith may have advantages in certain environments, the machine is quite complex. Moreover, Smith's approach wherein an excess volume of material is deposited onto a surface, then extra material removed and returned to a hopper for re-deposition, is inherently inefficient.

The present disclosure is directed to one or more of the problems or shortcomings set forth above.

SUMMARY OF THE INVENTION

In one aspect, the present disclosure provides a method of paving that includes sensing values indicative of a material feed demand for a surface to be paved, and depositing material onto the surface with the machine. The method further includes generating a control signal corresponding with an expected change in the material feed demand, and controlling depositing material onto the surface responsive to the control signal.

In another aspect, the present disclosure provides a machine having a frame, a material feed system configured to deposit a material onto a surface, and a screed coupled to the frame. The machine further includes a control system in control communication with the material feed system and having an electronic controller configured to determine an expected material feed demand and responsively output control signals to the material feed system to control depositing of material onto the surface.

In still another aspect, the present disclosure provides a control system for a machine that includes at least one sensor configured to sense values indicative of an expected feed demand, and a position sensor configured to output position signals indicative of a position of the machine relative to a reference position. The control system further includes an electronic controller configured to generate material feed rate control signals responsive to a determined position of the machine and the sensed values indicative of expected material demand.

DETAILED DESCRIPTION

Figure 1:
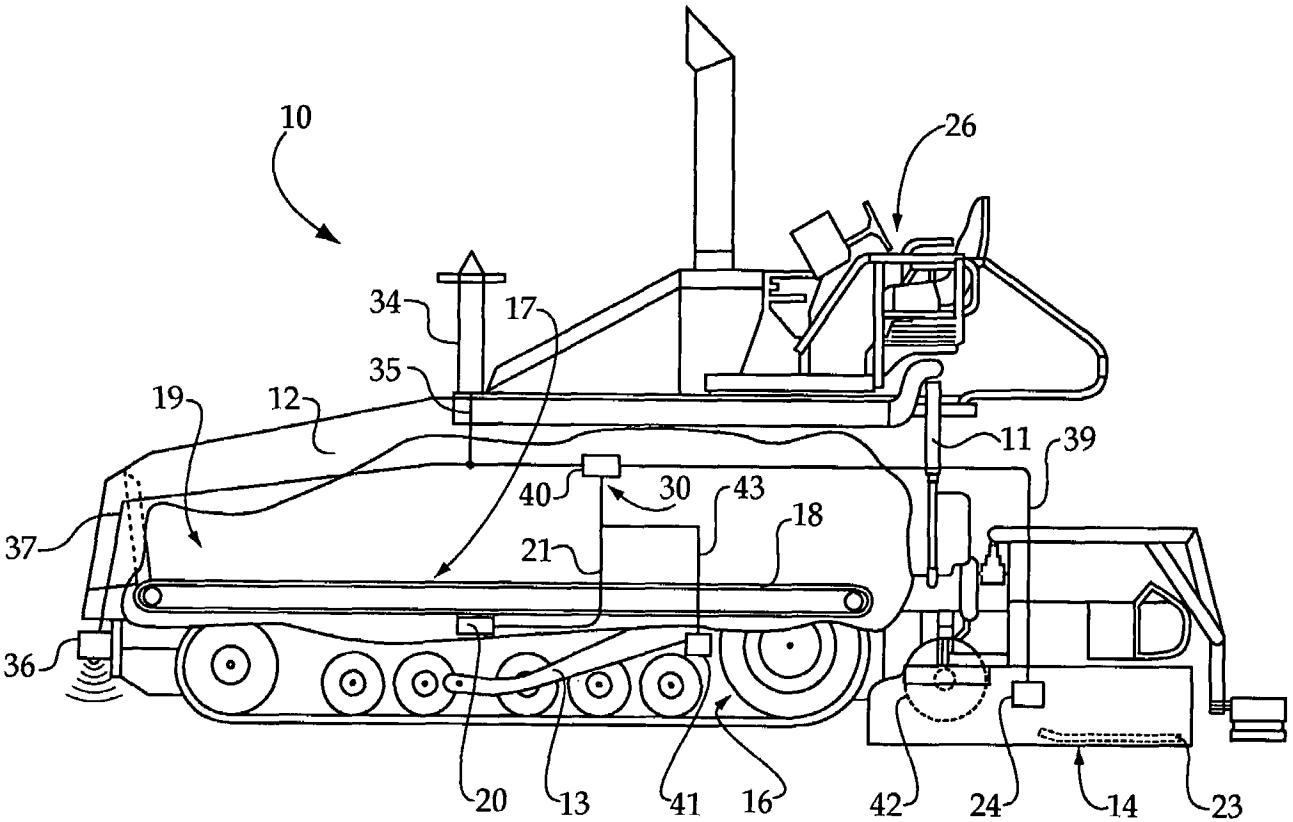
FIG. 1 is a side diagrammatic view of a machine according to one embodiment of the present disclosure.

Referring to FIG. 1, there is shown a machine 10 such as a paving machine in accordance with the present disclosure. Paving machine 10 includes a frame 12, and is illustrated in the context of a self-propelled machine having a track-type propulsion system 16 and an operator station 26. It should be appreciated, however, that rather than a self-propelled and/or operator controlled machine having a single frame unit as shown, machine 10 might be a tow-behind device, an articulated machine, or some other machine configuration or type. Machine 10 may further include a screed apparatus 14 having at least one screed shoe 23 and being coupled with frame 12 via linkage arm(s) 13. Screed apparatus 14 may be height adjustable, for example via one or more actuators 11, and may also be width adjustable, as described herein. In certain embodiments, screed apparatus 14 may comprise a plurality of shoes, and may comprise one or more screed shoes that are adjustable to vary an angle of attack relative to deposited material. Machine 10 may further include a hopper 19 wherein material such as a paving material comprising a mixture of asphalt and aggregate, or another material mixture, may be stored. During operation, material in hopper 19 may be replenished via a supply truck, or via some other means, as needed.

Machine 10 will further include a material feed system 17, comprising for example at least one conveyer 18 powered by a conveyer motor 20, and is configured to feed paving material from hopper 19 through machine 10 and onto a surface at a position in front of screed apparatus 14. Conveyor motor 20 may be, for example, a hydraulic motor coupled with a hydraulic pump of machine 10. Rather than an endless path conveyor, as shown, one or more feed augers or other material feed components may be used instead of or in addition to conveyor 18. Material deposited onto a surface in front of screed apparatus 14 may be distributed with a distribution auger 42, for example. Machine 10 may further include a control system 30 having an electronic controller 40 which is in control communication with conveyer motor 20 via a communication line 21 and configured to adjust a material feed rate at least in part via material feed rate control signals to conveyer motor 20.

A material feed rate in machine 10 may be controlled by adjusting a speed of conveyor 18. Where machine 10 is configured to operate in conjunction with a supply truck, material feeding from a supply truck might also be controlled according to the strategy described herein. Thus, control over material feed rate need not take place within a paving machine to fall within the fair scope of the present disclosure. A relative rate of rotation of distribution auger 42 may also be controlled in connection with controlling operation of conveyor 18. The present disclosure contemplates the use of any suitable rate-controllable material feed system. Electronic controller 40 will typically be configured to control a material feed rate in machine 10, and thereby control depositing of material onto a surface responsive to an expected material feed demand, as well as expected changes in material feed demand via a feed forward control strategy, as described herein.

Machine 10 may further include a plurality of sensors coupled with and/or included as components of control system 30. In particular, machine 10 may include a material head height sensor 24 such as a mechanical paddle sensor and the like, sonic sensor, or an optical sensor, configured to sense a head height of material deposited onto a work surface and distributed by distribution auger 42 in front of screed apparatus 14, in particular material deposited in front of screed shoe 23. Sensor 24 may be coupled with electronic controller 40 via another communication line 33.

Machine 10 may be further equipped with a means for determining its position relative to a reference position. In one embodiment, machine 10 may include a receiver 34 configured to receive remotely generated position signals, such as global positioning system satellite signals, which may be communicated via yet another communication line 35 to electronic controller 40. Machine 10 may alternatively, or in certain cases additionally, include a sensor such as an optical sensor 36 configured to output and/or receive position signals relative to a local reference position, for example a "stringline" extending longitudinally along one or more edges of a surface to be paved. Sensor 36 may be configured to communicate with electronic controller 40 via yet another communication line 37.

The foregoing apparatus and control system elements, or other suitable elements, may be used in a method of paving according to the present disclosure. The method of paving may include controlling material feed system 17 in a feed forward manner to control depositing material onto a surface such that a head height of the deposited material may be maintained or otherwise controlled despite changes in material feed demand. The use of a feed forward term corresponding to expected material feed demand and/or changes therein in the present control process will enable a smoother and higher quality paved surface than earlier designs which provided only for reactive adjustments of material feed rate.

The paving method may in particular include sensing values indicative of a material feed demand of a surface to be paved, hereinafter also referred to as material feed demand data, in advance of depositing material onto a region of the surface corresponding to the feed demand data. In one embodiment, the material feed demand data may be gathered via a sensor or sensing system that is separate from paving machine 10. In general terms, paving material demand data will be based on a desired width and thickness of the mat of paving material generated with paving machine 10. To this end, a sensor or sensing system may be passed along a surface to be paved in advance of a paving machine, collecting feed demand data associated with a paving width and a paving mat thickness which is to be generated. The sensed input values may be recorded on a computer readable medium and later uploaded to a computer readable medium of electronic controller 40 for use in determining an expected material feed demand, and changes in an expected material feed demand, such that material feed system 17 may be controlled as described herein. In one contemplated strategy, a map having paving width and paving thickness data, or simply material feed demand data, may be generated. Electronic controller 40 may determine a position of machine 10 relative to the map, for example via position signals from receiver 34, and output appropriate control commands to material feed system 17.

In an alternative embodiment, material feed demand data may be acquired during operating machine 10, but in advance of paving a region of the surface. In particular, sensor 36 may output signals indicative of a road width and hence a paving width change via sensing a stringline position or orientation, or some other reference, such that electronic controller 40 may responsively generate control signals to material feed system 17 to increase or decrease the material feed rate prior to changes in the feed demand. Regardless of the strategy for determining an expected material feed demand, electronic controller 40 may calculate, estimate, infer, or reference mapped information to determine when to initiate an increase or decrease in material feed rate, and the magnitude of the increase or decrease. The timing of outputting feed rate control signals to system 17 may depend upon such factors as the responsiveness of system 17, the distance material must be fed in machine 10, and the rate of change in the parameter such as paving width which is responsible for the expected change in material feed demand.

The method of paving may also include depositing material onto a surface to be paved with machine 10, generating a control signal corresponding with an expected change in paving width or other factors bearing on material feed demand, as described above, and controlling depositing material onto the surface via the control signal. Depositing material onto the surface may include placing a head of material in front of screed apparatus 14, whereas controlling depositing material onto the surface may include controlling a head height of the material placed in front of screed apparatus 14, for example, maintaining the head height. Machine propel speed may also affect the material feed demand and, hence, machine 10 may further include a speed sensor 41 configured to sense a commanded propel speed signal via a communication line 43 to electronic controller 40. Sensor inputs corresponding to expected variations in paving width, paving thickness and changes in commanded propel speed will allow control system 30 to maintain a relatively constant head height of material in front of screed apparatus 14, despite increases or decreases in material feed demand for machine 10 between a first portion of a surface to be paved, and at least a second portion. Electronic controller 40 may also be configured to receive grade/slope inputs for use in determining an appropriate material feed rate. In one contemplated embodiment, material head height will be maintained at a constant height throughout an entire paving operation, regardless of changes in material feed demand. Material head height sensor 24 may be used to confirm that a material head height is at or within an acceptable range of a desired head height, adding further robustness to the present control strategy.

INDUSTRIAL APPLICABILITY

Figure 2:
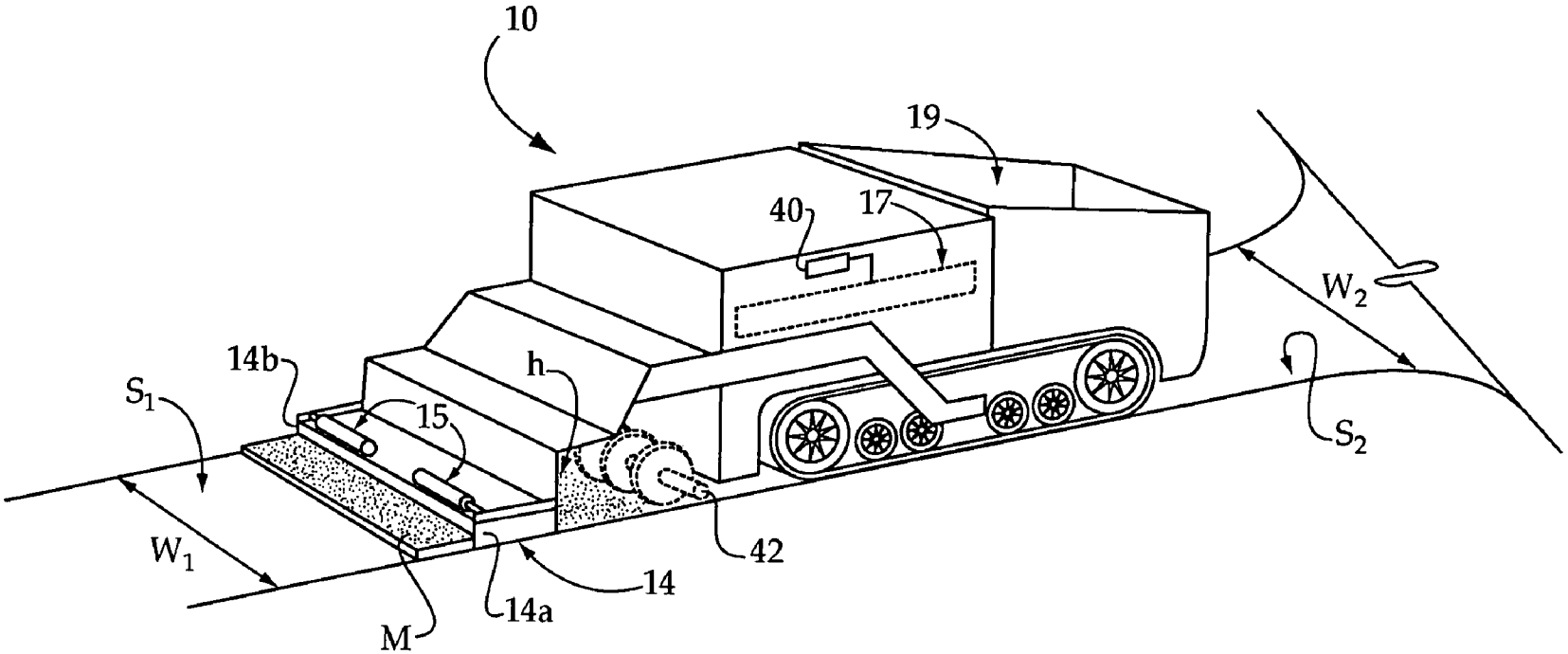
FIG. 2 is a perspective diagrammatic view of a paving machine according to one embodiment of the present disclosure.

Referring also to FIG. 2, there is shown a machine 10 similar to machine 10 of FIG. 1, having just begun paving a first portion of a surface $S_1$, defining a paving width $W_1$. Paving of surface portion $S_1$ may be initiated by loading material into hopper 19 and outputting a feed rate control signal with electronic controller 40 to material feed system 17 that corresponds with an expected material feed demand appropriate for paving surface portion $S_1$. Material will begin to move in machine 10 via material feed system 17, and will be deposited on surface portion $S_1$ in front of screed apparatus 14. Moving of machine 10 across surface portion $S_1$ may be initiated to begin laying a mat M of paving material.

So long as the expected material feed demand remains relatively constant, material feed system 17 may be operated at a relatively constant rate. As paving progresses, however, in the FIG. 2 example, machine 10 will eventually encounter a second surface portion $S_2$ defining a different paving width $W_2$, which in the illustrated example is a relatively greater paving width. Screed apparatus 14 is illustrated as a variable width screed having first and second screed extenders 14*a* and 14*b*, movable via actuators 15. Screed extenders 14*a* and 14*b* are shown in first, retracted positions in FIG. 2. When a determined position of machine 10 indicates that it is approaching second surface portion $S_2$, electronic controller 40 may output control signals to actuators 15 to begin extending screed extenders 14*a* and 14*b* toward second positions corresponding with paving width $W_2$. Changes in expected paving thickness, if any, may also be determined based on a determined position of machine 10 and incorporated into a determination of an appropriate feed rate control signal, in conjunction with changes in commanded propel speed, if any, and the expected change in paving width. Responsive to the foregoing factors, electronic controller 40 may output a feed rate control signal to material feed system 17 to adjust, in the illustrated case increase, a material feed rate in machine 10 to accommodate an expected increase in material feed demand. In a typical embodiment, electronic controller 40 will output an appropriate feed rate control signal in advance of screed extenders 14*a* and 14*b* reaching their second position corresponding to the expected change in paving width. In other words, material feed will be adjusted in advance of completing an adjustment in screed width to ensure that an appropriate volume of material continues to be provided and maintaining of a head height h of deposited material may be achieved.

Figure 3:
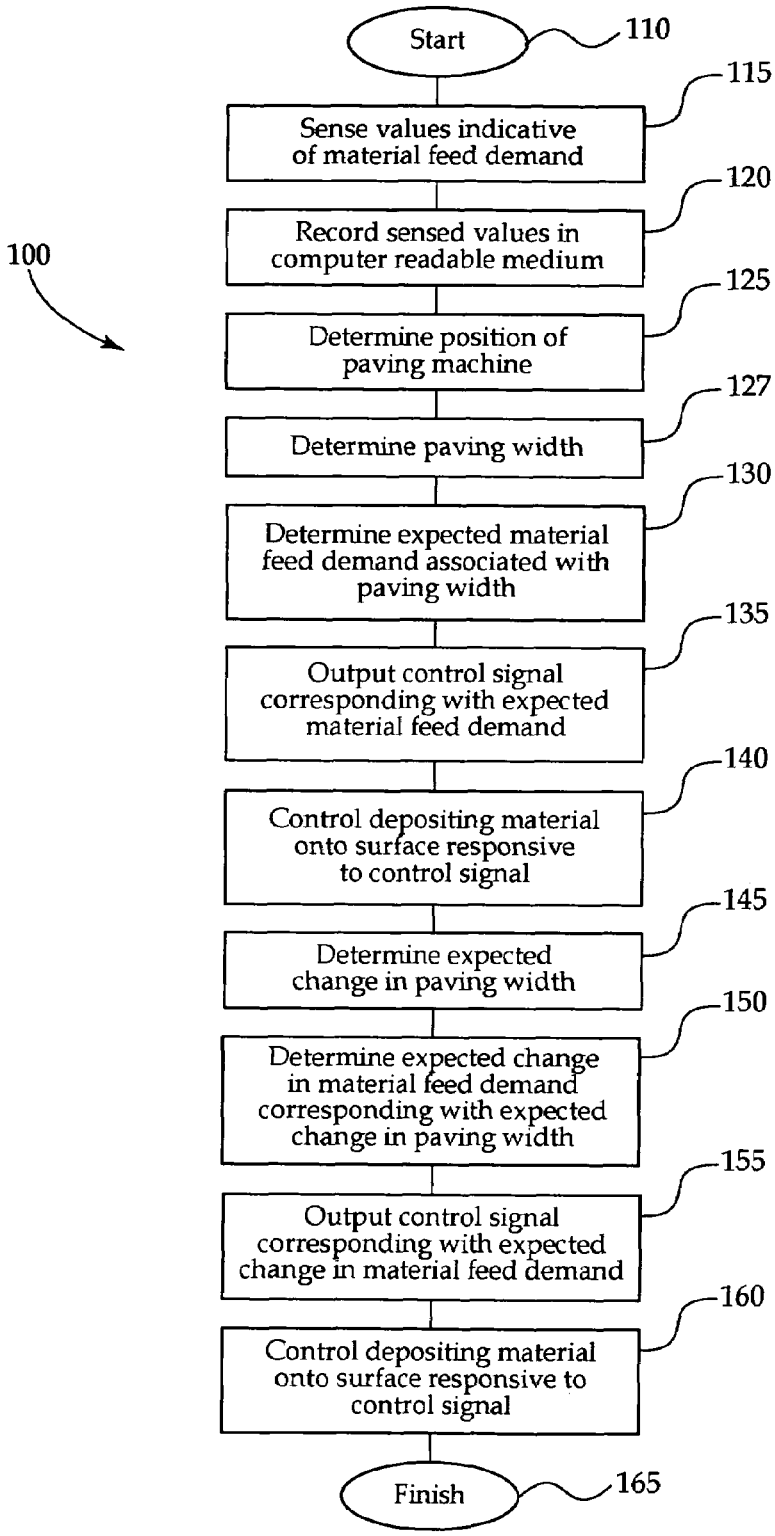
FIG. 3 is a flowchart illustrating a control process according to one embodiment of the present disclosure.

Referring to FIG. 3, there is shown a control process 100 according to the present disclosure. Control process 100 may begin at a start or initialize step, 110, from which it may proceed to Step 115 wherein values indicative of material feed demand for a surface to be paved may be sensed, as described herein. From Step 115, process 100 may proceed to Step 120 to record the sensed values in a computer readable medium, separate from or included with machine 10. From Step 120, the process may proceed to Step 125, wherein electronic controller 40 may determine a position of machine 10, for example via the receipt of signals with receiver 34, or with sensor 36. From Step 125, process 100 may proceed to Step 127 wherein electronic controller 40 may determine a paving width for machine 10.

From Step 127, process 100 may proceed to Step 130 wherein electronic controller 40 may determine an expected material feed demand associated with paving width determined in Step 127. From Step 130, process 100 may proceed to Step 135 wherein electronic controller 40 will output a control signal corresponding with the expected material feed demand, for example control signals to auger apparatus 22 and conveyer motor 20. From step 135, process 100 may proceed to Step 140 wherein electronic controller 40 may control depositing material onto the surface responsive to the control signal, for example by operating motor 20 at a speed such that it will begin to provide a relatively greater or relatively lesser material feed rate in machine 10. It should be appreciated that distribution auger 42 may also be controlled in conjunction with or in addition to motor 20 during the step of controlling depositing material onto the surface. For instance, where relatively more material is being deposited because screed apparatus 14 is being extended, it may be desirable to operate distribution auger 42 at a relatively higher speed.

From Step 140, process 100 may proceed to Step 145 wherein electronic controller 40 may determine an expected change in paving width, for example based on a position of machine 10 as compared to mapped material feed demand data. Alternatively, an expected change in paving width may be determined based on inputs from sensor 36, depending upon the embodiment. From Step 145, process 100 may proceed to Step 150 wherein electronic controller 40 may determine an expected change in material feed demand that corresponds with an expected change in paving width. From Step 150, process 100 may proceed to Step 155 wherein electronic controller 40 will output appropriate control signals corresponding with the expected change in material feed demand. From Step 155, process 100 may proceed to Step 160 wherein electronic controller 40 will control depositing material onto the surface responsive to the control signal generated in Step 155, similar to the manner in which deposition is controlled in Step 140. From Step 160, process 100 may proceed to Step 165 to Finish.

The present disclosure will provide advantages over conventional, reactive feed control systems. Rather than sensing a drop or increase in material head height, then speeding up or slowing down system 17, changes in feed demand are anticipated, and material feed increased or decreased in advance such that depositing of material onto the surface will take place at an optimum rate. Moreover, rather than depositing an excess of material or insufficient material onto areas which later require remediation, inherently inefficient, the present approach will consistently provide a more regular and uniform end product, improving overall paving operation consistency and efficiency.

The present description is for illustrative purposes only, and should not be construed to narrow the breadth of the present disclosure in any way. Thus, those skilled in the art will appreciate that various modifications might be made to the presently disclosed embodiments without departing from the intended spirit and scope of the present disclosure. For instance, while a paving machine represents one practical embodiment of the present disclosure, it is not limited thereto. The present disclosure may be applicable in other areas such as agriculture and earthmoving where feed forward control over material deposition will be advantageous. Other aspects, features and advantages will be apparent upon an examination of the attached drawings and appended claims.

What is claimed is:

1. A method of paving comprising the steps of:

sensing values indicative of a material feed demand for a surface to be paved, including sensing values indicative of an expected change in material feed demand;

depositing material onto the surface with a material feed system of a machine;

outputting a feed forward control signal corresponding with the expected change in the material feed demand in advance of the expected change occurring, during depositing material onto the surface; and controlling depositing material onto the surface responsive to the control signal at least in part via a step of using the material feed system such that depositing material in excess of the material demand indicated by the sensed values is inhibited.

2. The method of claim 1 wherein the depositing step further comprises a step of placing a head of material in front of a screed of the machine, and wherein the controlling step further comprises controlling a head height of the deposited material responsive to the expected change in the material feed demand.

3. The method of claim 2 wherein the controlling step further comprises maintaining a constant height head of material in front of the screed of the machine, including commanding increasing or decreasing a rate of depositing material responsive to an expected increase or decrease in the material feed demand, respectively.

4. The method of claim 2 wherein the step of placing a head of material in front of a screed comprises placing a head of material in front of a variable width screed of the machine, the method further comprising a step of adjusting a screed width responsive to a paving width change, the paving width change at least in part defining the expected change in material feed demand.

5. The method of claim 4 further comprising the steps of:

determining an expected paving width change responsive to the sensed values;

adjusting the screed from a first screed width to a second screed width responsive to the expected paving width change;

determining an expected change in the material feed demand which corresponds with the expected paving width change; and commanding adjusting the material feed rate via the outputting step prior to completing adjusting the screed to the second screed width.

6. The method of claim 5 further comprising the steps of:

recording the sensed values indicative of material feed demand; and receiving signals indicative of a position of the machine relative to a reference position;

wherein the outputting step comprises generating the control signal responsive to the recorded values and a determined position of the machine.

7. The method of claim 6 wherein the recording step comprises recording the sensed values on a computer readable medium separate from the machine, the method further comprising a step of uploading the recorded values to a computer readable medium of the paving machine subsequent to the recording step.

8. The method of claim 2 wherein the sensing step further comprises sensing values indicative of desired paving width, desired paving height and commanded machine propel speed, wherein the outputting step further comprises:

outputting a first control signal during paving a portion of the surface which corresponds with an expected increase in material feed demand associated with at least one of, an expected increase in paving width, an expected increase in paving height and an increase in commanded machine propel speed; and outputting a second control signal during paving a different portion of the surface which corresponds with an expected decrease in material feed demand associated with at least one of, an expected decrease in paving width, an expected decrease in paving height and a commanded decrease in machine propel speed.

9. The method of claim 8 wherein the sensing step further comprises sensing values indicative of at least one of desired paving width and desired paving height with a sensor separate from the machine.

10. The method of claim 8 wherein the sensing step further comprises sensing values indicative of at least one of desired paving width and desired paving height with a sensor of the machine.

11. A machine comprising:

a frame;

a material feed system configured to deposit a material onto a surface;

a screed coupled to said frame; and a control system in control communication with said material feed system and having an electronic controller configured to receive inputs indicative of an expected material feed demand for depositing material onto the surface, said electronic controller being further configured to determine an expected material feed demand and an expected change in material feed demand based at least in part on the inputs and responsively output feed forward control signals to said material feed system in advance of the expected change occurring and during depositing material onto the surface, the electronic controller being further configured to control depositing of material onto said surface in a manner such that depositing material in excess of the expected material feed demand is inhibited.

12. The machine of claim 11 wherein said screed comprises a variable width screed, said electronic controller being configured via a control algorithm having a feed forward term to determine the expected material feed demand responsive to sensed values associated with a width of said variable width screed.

13. The machine of claim 12 further comprising a sensor configured to sense values indicative of a position of said machine relative to a reference position, said electronic controller being configured to determine said feed forward term responsive to said signals.

14. The machine of claim 13 wherein said sensor comprises an optical position sensor configured to receive position signals indicative of a position of said machine relative to said reference position.

15. The machine of claim 13 wherein said electronic controller is configured to determine a position of said machine relative to mapped position data stored in a computer readable medium.

16. The machine of claim 13 wherein said electronic controller is further configured to control a head height of material deposited onto the surface at least in part via the feed forward term of said control algorithm.

17. A control system for a machine comprising:

at least one sensor configured to sense values indicative of an expected material feed demand and an expected change in the material feed demand, for depositing material onto a surface with the machine;

a position sensor configured to output position signals indicative of a position of said machine relative to a reference position; and an electronic controller configured to output feed forward material feed rate control signals to a material feed system of the machine in advance of the expected change occurring and during depositing material onto the surface, responsive to a determined position of said machine and the sensed values indicative of the expected change in material feed demand, and the electronic controller being further configured to control depositing material onto the surface in a manner such that depositing material in excess of the expected material feed demand is inhibited.

18. The control system of claim 17 wherein said electronic controller is further configured to control a head height of material deposited onto the surface via said feed rate control signals.

19. The control system of claim 18 wherein said electronic controller is in communication with said at least one sensor.

20. The control system of claim 18 wherein the machine comprises a paving machine, and wherein said electronic controller is further configured to maintain the head height of material at least in part by outputting control signals to a material feed system of the machine prior to or during adjusting a variable width screed of the machine to accommodate a change in paving width.

* * * * *